US011142442B2

(12) United States Patent
Gault et al.

(10) Patent No.: US 11,142,442 B2
(45) Date of Patent: Oct. 12, 2021

(54) SYSTEM AND METHOD FOR DYNAMICALLY CONTROLLING THE STABILITY OF AN INDUSTRIAL VEHICLE

(71) Applicant: Arrow Acquisition, LLC, Lenexa, KS (US)

(72) Inventors: Ross T. Gault, Olathe, KS (US); Terrence S. Melvin, Overland Park, KS (US)

(73) Assignee: ARROW ACQUISITION, LLC, Lenexa, KS (US)

( * ) Notice: Subject to any disclaimer, the term of this patent is extended or adjusted under 35 U.S.C. 154(b) by 738 days.

(21) Appl. No.: 15/893,996

(22) Filed: Feb. 12, 2018

(65) Prior Publication Data

US 2018/0229988 A1 Aug. 16, 2018

Related U.S. Application Data

(60) Provisional application No. 62/457,664, filed on Feb. 10, 2017.

(51) Int. Cl.
*B66F 9/075* (2006.01)
*B66F 17/00* (2006.01)
(Continued)

(52) U.S. Cl.
CPC ..... *B66F 17/003* (2013.01); *B66F 9/075* (2013.01); *B66F 9/24* (2013.01); *E02F 9/24* (2013.01);
(Continued)

(58) Field of Classification Search
CPC .... B66F 7/22; B60G 2300/022; G01G 19/083
See application file for complete search history.

(56) References Cited

U.S. PATENT DOCUMENTS 4,265,337 A 5/1981 Dammeyer
4,511,974 A 4/1985 Nakane et al.
(Continued)

FOREIGN PATENT DOCUMENTS

DE 10323642 A1 1/2005
DE 102012101500 A1 8/2013
(Continued)

OTHER PUBLICATIONS

RDS Technology Ltd., Liftlog 1000, www.rdstec.com, p. 2-4, RDS Technology Ltd, Cirencester Road, Minchinhampton, Stroud, Glos, GL6 9BH, UK, 2014.
(Continued)

*Primary Examiner* — Peter D Nolan
*Assistant Examiner* — Ce Li Li
(74) *Attorney, Agent, or Firm* — Husch Blackwell LLP

(57) ABSTRACT

A system and method for monitoring the dynamic load moment and stabilization of a lifting vehicle is provided. The system is adapted for monitoring the stability of the vehicle on a real-time basis, and displaying the real-time dynamic load moment of the vehicle/cargo combination on a continuous scale on a user interface. The system may also include an object detection device oriented for determining the presence or absence of a floor surface within a specified distance from the vehicle in order to detect drop-offs in the floor surface surrounding the vehicle and alert the operator of same. A method for calibrating the system is also provided. The calibration method can include a series of lift and acceleration steps for collecting static and dynamic data in order to determine one or more coefficients associated with the vehicle.

9 Claims, 8 Drawing Sheets

(51) Int. Cl.
*B66F 9/24* (2006.01)
*E02F 9/26* (2006.01)
*E02F 9/24* (2006.01)

(52) U.S. Cl.
CPC ..... *E02F 9/26* (2013.01); *E02F 9/261* (2013.01); *E02F 9/264* (2013.01)

(56) References Cited

U.S. PATENT DOCUMENTS

| | | | | |
|---|---|---|---|---|
| 4,516,116 | A | 5/1985 | White | |
| 4,852,674 | A | 8/1989 | Gudat | |
| 4,942,529 | A | 7/1990 | Avitan et al. | |
| 4,949,263 | A | 8/1990 | Jurca | |
| 5,011,358 | A | 4/1991 | Anderson et al. | |
| 5,067,572 | A | 11/1991 | Kyrtsos et al. | |
| 5,113,344 | A | 5/1992 | Kellogg et al. | |
| 5,160,055 | A | 11/1992 | Gray | |
| 5,208,753 | A | 5/1993 | Acuff | |
| 5,586,620 | A | 12/1996 | Dammeyer et al. | |
| 5,652,486 | A | 7/1997 | Mueller et al. | |
| 5,687,081 | A | 11/1997 | Wellman et al. | |
| 6,025,563 | A | 2/2000 | Lesesky et al. | |
| 6,170,681 | B1 | 1/2001 | Yoshimatsu | |
| 6,194,860 | B1 | 2/2001 | Seelinger et al. | |
| 6,286,629 | B1 | 9/2001 | Saunders | |
| 6,592,230 | B2 | 7/2003 | Dupay | |
| 6,611,746 | B1 | 8/2003 | Nagai | |
| 6,785,597 | B1 | 8/2004 | Farber et al. | |
| 6,855,894 | B1 | 2/2005 | Van Seumeren | |
| 6,954,150 | B2 | 10/2005 | Nishimura et al. | |
| 6,965,823 | B2 | 11/2005 | Wichner | |
| 6,985,795 | B2 | 1/2006 | Scotese | |
| 7,010,404 | B2 | 3/2006 | Ichijo et al. | |
| 7,165,643 | B2 * | 1/2007 | Bozem | B66F 17/003 180/19.2 |
| 7,216,024 | B1 * | 5/2007 | Abels | B60T 8/241 340/685 |
| 7,219,769 | B2 | 5/2007 | Yamanouchi et al. | |
| 7,252,203 | B2 | 8/2007 | Frankenberger et al. | |
| 7,320,385 | B2 | 1/2008 | Katae et al. | |
| 7,366,600 | B2 | 4/2008 | Osaki et al. | |
| 7,380,375 | B2 | 6/2008 | Maly | |
| 7,599,762 | B2 | 10/2009 | Discenzo et al. | |
| 7,992,686 | B2 | 8/2011 | McCabe | |
| 8,055,405 | B2 | 11/2011 | Baginski et al. | |
| 8,094,035 | B2 | 1/2012 | Lane, Jr. | |
| 8,140,228 | B2 | 3/2012 | McCabe et al. | |
| 8,146,813 | B2 | 4/2012 | King et al. | |
| 8,265,836 | B2 | 9/2012 | Yamada et al. | |
| 8,731,785 | B2 | 5/2014 | McCabe et al. | |
| 8,751,084 | B2 | 6/2014 | Marwell | |
| 8,768,581 | B2 | 7/2014 | Mizuochi et al. | |
| 8,793,054 | B2 | 7/2014 | Sjögren et al. | |
| 8,909,426 | B2 | 12/2014 | Rhode et al. | |
| 8,947,251 | B2 | 2/2015 | Finkbeiner | |
| 2004/0200644 | A1 | 10/2004 | Paine et al. | |
| 2005/0102081 | A1 | 5/2005 | Patterson | |
| 2008/0011554 | A1 | 1/2008 | Broesel et al. | |
| 2009/0059004 | A1 | 3/2009 | Bochicchio | |
| 2010/0049398 | A1 | 2/2010 | Bryant et al. | |
| 2011/0196623 | A1 | 8/2011 | Häkkinen | |
| 2011/0203059 | A1 | 8/2011 | Whitley et al. | |
| 2011/0286007 | A1 | 11/2011 | Pangrazio et al. | |
| 2014/0267362 | A1 | 9/2014 | Kocienda et al. | |
| 2014/0277691 | A1 | 9/2014 | Jacobus et al. | |
| 2014/0277871 | A1 | 9/2014 | Goncalves et al. | |
| 2015/0002303 | A1 | 1/2015 | Stanley et al. | |
| 2015/0029017 | A1 | 1/2015 | Thoreson et al. | |
| 2018/0029849 | A1 * | 2/2018 | Beer | B66C 13/08 |

FOREIGN PATENT DOCUMENTS

| | | | |
|---|---|---|---|
| EP | 0353099 | A2 | 1/1990 |
| EP | 0360870 | A1 | 4/1990 |
| EP | 0800129 | A1 | 10/1997 |
| EP | 0959038 | A2 | 11/1999 |
| EP | 1361190 | A1 | 11/2003 |
| EP | 1512575 | A2 | 3/2005 |
| EP | 1522830 | A1 | 4/2005 |
| GB | 2437629 | A | 10/2007 |
| WO | 2004069568 | A1 | 8/2004 |
| WO | 2008057504 | A2 | 5/2008 |
| WO | 2017078518 | A1 | 5/2017 |

OTHER PUBLICATIONS

Skidweigh Technology, ED6, http://www.skidweight.com/ed6-skidfleet-series.html, p. 2-3, Jan. 28, 2016.

Wheel Loader Scales, Weighlog 3030 and Weighlog Vue, http://loupelectronics.com/industrial-products/wheel-loader-scales.html, 2016.

MH&L Material Handeling & Logistics, Hydraulic Scale for Forklift Trucks, http://mhlnews.com/new-products/hydraulic-scale-forklift-trucks-new-products, Dec. 21, 2015.

VEGA Italian Style for Lifts, Display TFT, http://www.vegalift.it/documents/TFT%205.7%20%20%5BENG-VEGA%5D%20rev%2005.pdf, 2010.

Touch Screen Console Controls Mobile Column Lifts, Smart Control System, http://www.truckinginfo.com/channel/products/product/detail/2015/01/touch-screen-console-controls-mobile-column-lifts.aspx, Jan. 12, 2015.

Roger Bostelman, Towards Improved Forklift Safety, Mobility and Manipulation Project Intelligent Systems Division, Manufacturing Engineering Laboratory, National Institute of Standards and Technology, Department of Commerce, Gaithersburg, MD, Oct. 16, 2009.

* cited by examiner

POSITIONING OF DYNAMIC LOAD MOMENT

SYSTEM AND METHOD FOR DYNAMICALLY CONTROLLING THE STABILITY OF AN INDUSTRIAL VEHICLE

CROSS-REFERENCE TO RELATED APPLICATIONS

This Application claims priority to U.S. Provisional Patent Application Ser. No. 62/457,664, filed on Feb. 10, 2017, to Ross T. Gault and Terrence S. Melvin entitled "System and Method for Dynamically Controlling the Stability of an Industrial Vehicle," currently pending, the entire disclosure of which is incorporated herein by reference.

FIELD OF THE INVENTION

The present invention relates generally to safety and monitoring systems, and in particular, safety and monitoring systems for industrial vehicles and machines such as forklifts, skid steers, telehandlers, excavators, Marina Bulls™, wheel loaders, backhoes and other items for lifting, moving and transporting loads.

BACKGROUND OF THE INVENTION

Safety systems for industrial vehicles and machines, particularly forklift machines, as commonly known in the art, are configured to determine the weight and center of gravity of a cargo load. By using the cargo weight and center of gravity, these safety systems can alert an operator about possible tip-over events or other safety situations.

However, these known safety systems are not without shortcomings. Such problems include, for example, the means by which a dynamic load moment of a vehicle/cargo combination is conveyed and presented to the operator thereby impacting the operator's ability to react to potential tip-over events. Another shortcoming relates to an inability to detect drop-offs in the floor around the vehicle and alert the operator of such drop-offs. Furthermore, modifications to a vehicle, such as a change in its attachments or other alterations that may impact its operating characteristics, can have significant effects on the accuracy and effectiveness of known safety systems.

Accordingly, a need exists for a system capable of dynamically monitoring and effectively displaying information to the operator relating to the stability of the vehicle. Another need exists for a system adapted for detecting and alerting the operator of drop-offs in the floor around the vehicle. A further need exists for a system that can be calibrated or recalibrated to take into account changes made to the vehicle or its attachments, or instances where the system is installed on an existing vehicle.

SUMMARY OF THE INVENTION

The present invention is directed to a system and method that can be configured to monitor the dynamic load moment and stabilization of a lifting vehicle (e.g., forklift, telehandler, marina bull, wheel loader, backhoe, and other types of equipment for lifting, moving and transporting loads) and provide real-time information to the vehicle's operator. More specifically, the system and method can determine the load and center of gravity of cargo on the vehicle and calculate the overall load moment of the vehicle/cargo combination in order to aid an operator in preventing instability and/or tipping of the vehicle. In the case of a forklift, this could be a forward tipping through the lifting up of the rear wheels.

The system can include a plurality of sensors that monitor several different components, positions and states of the lifting vehicle and its cargo load. The collected sensor data can be received by an electronic control unit and pushed through to a graphical user interface of a mobile device by an on-board network. The interface device and/or the electronic control unit can include an application or program having a dynamics model and/or algorithm configured for incorporating the sensor data to determine the load moment applied to the vehicle/cargo combination in real time. This information can be conveyed and/or displayed to the vehicle operator through a display provided on the interface device.

One aspect of the present invention is directed to a method for calibrating the system. This calibration method may be employed any time an attachment is replaced, added or removed from the vehicle, any time there are changes made to the vehicle that may impact its operating characteristics, or any time an existing vehicle is retrofitted with a safety system, for example.

One or more acceleration and/or deceleration tests or routines may be undertaken as part of the calibration method. In that regard, a no-load acceleration routine may be performed that includes the steps of accelerating the vehicle with its lifting device at a first position, accelerating the vehicle again with its lifting device at a second position, and accelerating the vehicle yet again with its lifting device at a third position. The no-load acceleration routine is typically performed without any cargo placed on the lifting device. A first-load acceleration routine may be performed that also includes the steps of accelerating the vehicle with its lifting device at a first position, accelerating the vehicle with its lifting device at a second position, and accelerating the vehicle with its lifting device at a third position. The first-load acceleration routine is performed with a first cargo load having a known mass placed on the lifting device. Similarly, a second-load acceleration routine may be performed wherein the same steps are undertaken with a second cargo load having a different known mass placed on the lifting device. During the acceleration routines, the acceleration of the vehicle and a force on the tilt cylinder of the lifting device can be measured during one or more instances of each acceleration routine. The force on the tilt cylinder may be determined by measuring a pressure within the tilt cylinder and multiplying that pressure by an effective surface area of the cylinder's piston, for example.

The calibration method may also include the steps of inputting configuration information of the vehicle into the system, measuring a slope of the ground floor beneath the vehicle and inputting the slope into the system, measuring an angle of a mast of the lifting device and inputting the mast angle into the system, and measuring an angle of the tilt cylinder of the lifting device and inputting the tilt cylinder angle into the system.

The calibration method may further include the steps of determining a location of a center of gravity of the vehicle during the no-load acceleration routine, determining a load moment of the vehicle during the no-load acceleration routine, determining a location of a center of gravity of the vehicle and the first cargo load combination during the first-load acceleration routine, and determining a load moment of the vehicle and the first cargo load combination during the first-load acceleration routine. Similarly, the center of gravity and load moment may also be calculated for the second-load acceleration routine.

The data collected during the acceleration routines is used to calculate at least one coefficient associated with the vehicle. The coefficient(s) may be calculated based on certain variables, such as a mass of the vehicle, an acceleration of the vehicle, a force on the tilt cylinder, and/or a position of the lifting device. The coefficient(s) may be determined by a linear regression of the data collected during the acceleration routines. Once calculated, the coefficient(s) can be stored within the system and used by the mathematical formulas, algorithms and routines employed when dynamically monitoring the stability of the vehicle.

Another aspect of the present invention is directed to providing a user interface that includes a continuous scale for displaying the real-time dynamic load moment of the vehicle/cargo combination. In one embodiment, the dynamic load moment is presented in the form of a vertical bar having a gradient from one end to the other end. The color or shade of the gradient can provide the operator with an easy to understand visualization. The dynamic load moment can also be displayed as a percentage of used load moment capacity of the vehicle.

A further aspect of the present invention is directed to a system for detecting drop-offs in the floor surface surrounding the vehicle. In that manner, the system can include at least one object detection device oriented to detect a presence or absence of a floor surface within a specified distance from the vehicle. The object detection device can be adapted for detecting a drop-off in the surface of the floor and, more specifically, a drop-off in the surface of the floor that exceeds a specified threshold. The object detection device may be any suitable device, such as an optical sensor or a 3D sensor. Moreover, the system may include a device for alerting the operator if a floor surface is not present in the projected path of travel of the vehicle. This alert device may take the form of a visual alert device, an audible alert device, or a haptic alert device, for example. In one embodiment, the system is adapted for overtaking control of at least one of the vehicle's speed, throttle, brakes and steering when a drop-off within a specified distance from the vehicle is detected.

Other aspects and advantages of the present invention will be apparent from the following detailed description of the preferred embodiments and the accompanying drawing figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
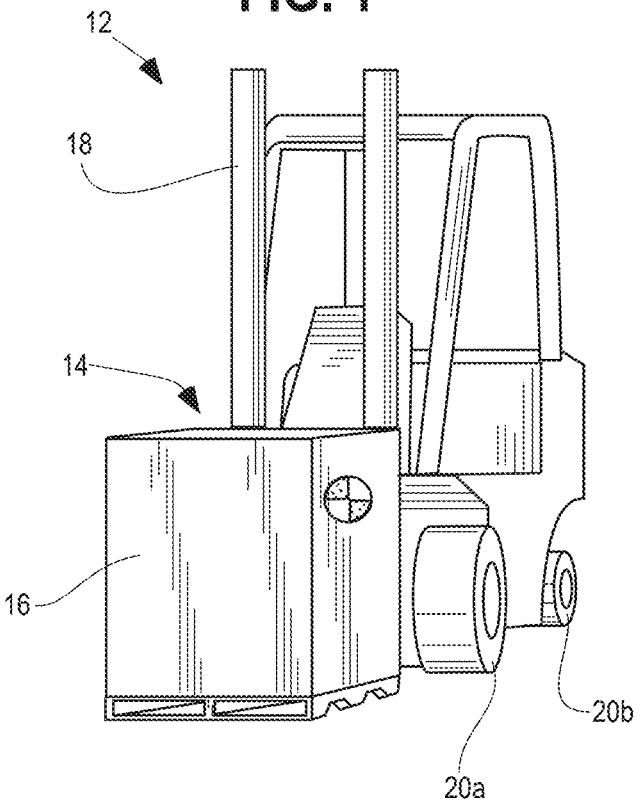
FIG. 1 is a front perspective view of a forklift machine in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed to an industrial vehicle or machine safety device system 10 as schematically represented through the several figures. System 10 can be used in connection with an industrial vehicle 12, such as a forklift machine, a telehandler, marina bull, wheel loader, backhoe, vehicle or other machine for lifting, moving and transporting material, cargo or other loads. Vehicle 12 may have a lifting device or apparatus that can include an attachment such as one or more forks, a bucket, a shovel, a grapple, or other attachment adapted for lifting, moving or transporting material, cargo or other loads.

Figure 2:
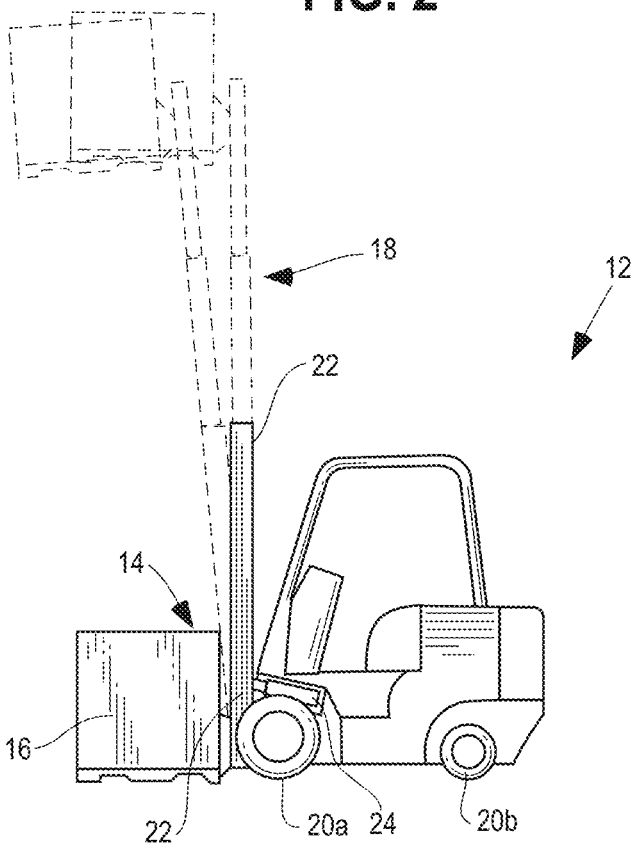
FIG. 2 is a side view of a forklift machine in accordance with one embodiment of the present invention.

According to one embodiment of the present invention, as shown in the figures, system 10 can be configured as a forklift safety device system for use with a forklift 12. However, it will be appreciated that system 10 can be configured for other types of industrial vehicles or machines and for use with multiple types of industrial vehicles or machines. As shown in FIG. 1, forklift 12 can be any type of forklift commonly known in the art and can include an implement or attachment 14 (such as forks or a bucket) that can be used to lift and/or transport a cargo load 16. Forklift 12 can additionally include a mast assembly 18, front wheels 20*a* and rear wheels 20*b*. As shown in FIG. 2, forklift 12 can further include a mast lift cylinder 22 for raising/lowering attachment 14 and a mast tilt cylinder 24 for tilting the mast assembly 18 and attachment 14.

System 10 can be configured to monitor the status of forklift 12 and cargo load 16 in order to alert the vehicle operator (or others) of potential hazards, such as operational environment hazards (e.g., ramps, docks, stairs, and other obstacles), pedestrian hazards, and vehicle operation hazards (e.g., tipping events, visibility, and enclosed environments). In particular, system 10 can be configured to calculate and monitor the center of gravity and dynamic load moment of the forklift 12 and cargo load 16 combination as described in greater detail below. As also described in greater detail below, system 10 can be configured to monitor and display the current status of the dynamic load moment in real time to the vehicle operator, alert the vehicle operator when the load moment goes beyond a specified threshold and/or override the controls of forklift 12 in the event of an imminent tip-over event. System 10 can additionally monitor, display and alert the vehicle operator regarding other conditions or factors of forklift 12, such as vehicle speed, pedestrian and/or hazard presence, and drop-offs.

Figure 3:
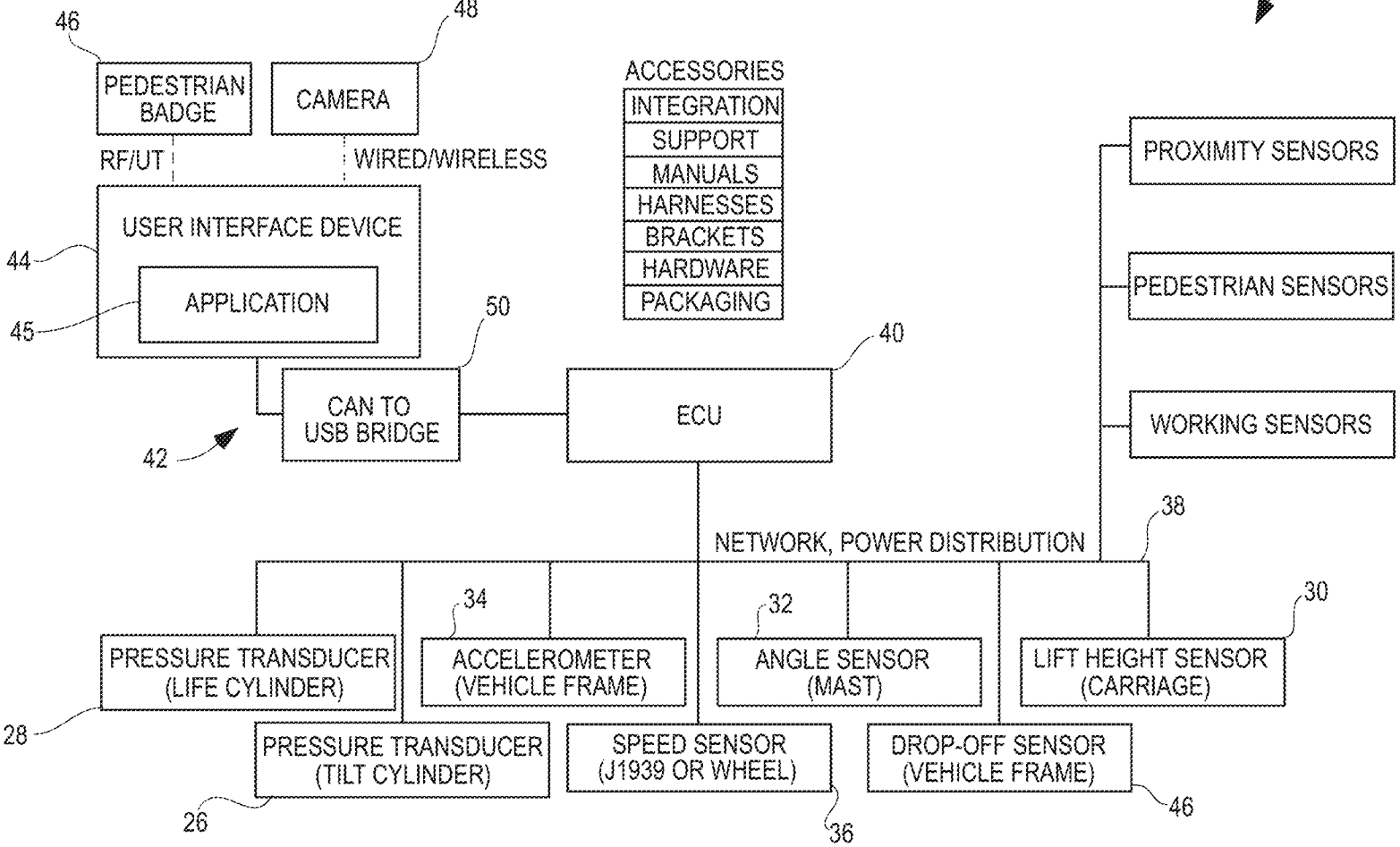
FIG. 3 is a diagram of an industrial vehicle safety device system in accordance with one embodiment of the present invention.
Figure 4:
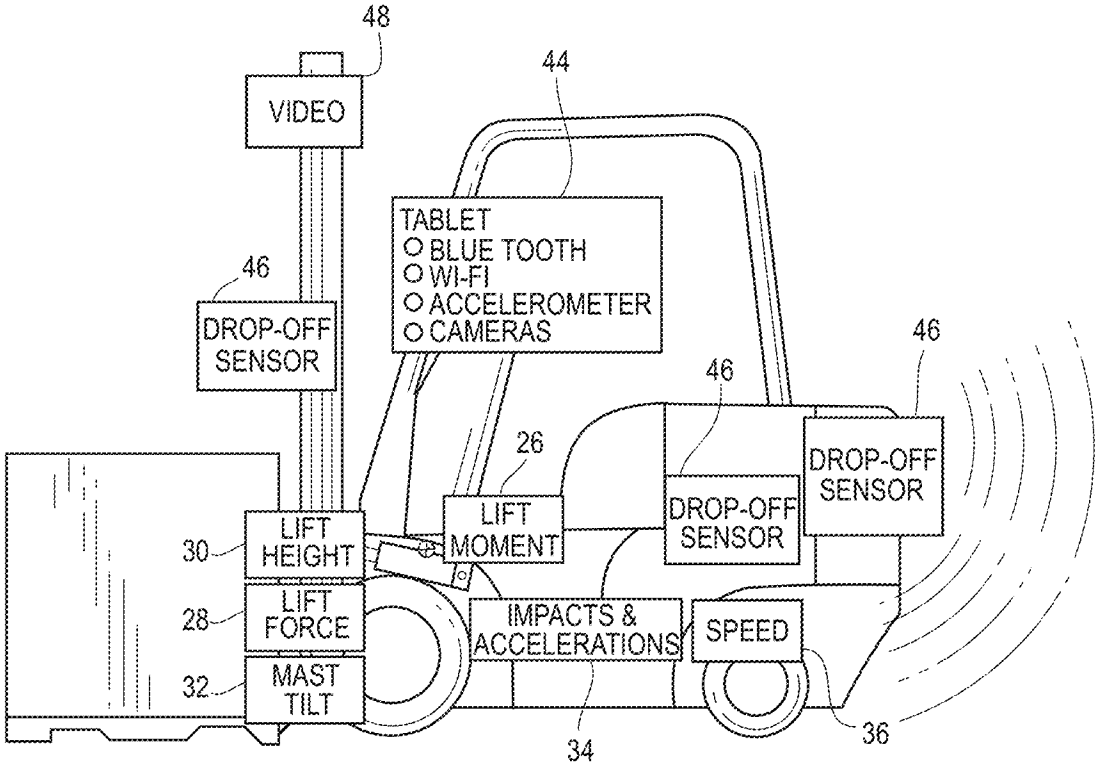
FIG. 4 is a schematic view of a forklift machine equipped with an industrial vehicle safety device system in accordance with one embodiment of the present invention.

Turning now to FIGS. 3-6, the configuration and operation of system 10 according to at least one embodiment of the present invention will be described. As shown in FIGS. 3 and 4, system 10 can include a plurality of sensors, including sensors 26, 28, 30, 32, 34 and 36 for monitoring the position, acceleration, speed, orientation and other dynamic states of vehicle 12 and cargo load 16 during operation of vehicle 12. As also shown in FIG. 4, system 10 can optionally include many other types of sensors for monitoring the surrounding areas of the vehicle 12, such as proximity sensors, pedestrian sensors and working sensors. The data collected by these sensors 26-36 (described in greater detail below) can be transported over an on-board electronic network 38 to an electronic control unit ("ECU") 40 or other suitable control module, which can operate as a node for a controller area network ("CAN") 42 or other suitable communication network for system 10. ECU 40 can manage on-board network 38, CAN 42 and sensors 26-36 and can process the sensor data before sending it to a processor, central processing unit ("CPU") and/or user interface device 44, such as a mobile tablet or other onboard device. The processor or user interface device 44 can execute an application or program software 45 configured to use the sensor data or other information from the ECU, CPU or other processor to determine and display the dynamic conditions of vehicle 12 on a real-time, semi-continuous or time-interval basis. It will be appreciated that, in one embodiment, one or more of the ECU, control module, CPU or other processor, and user interface may be incorporated into a single on-board electronic device. As also shown in FIGS. 3 and 4, system 10 can further include one or more obstacle sensors 46 and a video camera 48, as will be described in greater detail below.

Sensor 26 can be a pressure transducer sensor located in tilt cylinder 24 and can collect data relating to the dynamics of vehicle 12 via mast assembly 18, including but not limited to pressure and force used in identifying and calculating the load center of the vehicle 12/cargo load 16 combination. In one embodiment, sensor 26 is adapted for measuring the pressure of the hydraulic fluid in the rod end of tilt cylinder 24. In alternative embodiments, sensor 26 may comprise a load cell, force transducer or any other suitable force-measuring sensor that is that is connected, directly or indirectly, to the tilt cylinder 24 such as at a clevis, yoke, pinned joint, or other connection point.

Sensor 28 can be a pressure transducer sensor located in lift cylinder 22 that can collect data relating to the dynamics of vehicle 12 and the weight of the lifted cargo load 16 via mast assembly 18, including but not limited to weight, pressure and force. In one embodiment, sensor 28 is adapted for measuring the pressure of the hydraulic fluid in the base end of lift cylinder 22. In alternative embodiments, sensor 28 may comprise a load cell, force transducer or any other suitable force-measuring sensor that is that is connected, directly or indirectly, to the lift cylinder 22, such as at a clevis, yoke, pinned joint, or other connection point.

Sensor 30 can be a sensor located at or near the mast assembly 18 for determining the height or vertical position of mast assembly 18 and attachment 14 in order to determine the height of cargo load 16. Lift height sensor 30 may be any suitable type of sensor, such as an electronic, magnetic, optical, radio frequency, mechanical, proximity, or contact sensor or any other suitable height reference sensor.

Sensor 32 can be a sensor for sensing the angle of mast assembly 18. Sensor 32 may be an inclinometer, rotary, potentiometer, encoder, Hall effect, electronic, magnetic, optical, radio frequency, mechanical, proximity, or contact sensor or any other suitable angle reference sensor.

Sensor 34 can be an accelerometer sensor located on vehicle 12 for determining accelerations, decelerations, movements and orientation angles associated with vehicle 12. Sensor 34 may be any suitable type of sensor, such as a potentiometric, Hall effect, capacitive, piezoresistive accelerometer, micro-electro mechanical system, single-axis, multiple-axis, sensor or any other suitable acceleration-measuring or accelerometer sensor.

Sensor 36 can be a speed sensor and may be located in the drive train for sensing the speed of vehicle 12. Speed data can also or alternatively be acquired from the CAN 42. Sensor 36 may be any suitable type of sensor, such as a wheel speed, drivetrain, rotary, encoder, radar, GPS, electronic, or mechanical sensor or any other suitable speed-measuring sensor.

Gyroscope sensors, tilt sensors, GPS receivers, brake sensors, and other sensors and devices suitable for determining the tilt, angle, pitch, roll, yaw, direction, location, speed, acceleration or other orientation of the vehicle 12 or any component thereof may also be utilized in connection with the present invention.

Collectively, sensors 26-36 can be used to derive the load moment of the vehicle 12/cargo load 16 combination by collecting any number of different measurements and data, including but not limited to: the pressure of the hydraulic fluid in rod end of tilt cylinder 24, the force on tilt cylinder 24, the pressure of the hydraulic fluid in the base end of lift cylinder 22, the force on lift cylinder 22, the height of the forks or other attachment 14 above the ground or other reference point, the angle of mast assembly 18, the mass of mast assembly 18, the location of the center of gravity of mast assembly 18, the mass of vehicle 12, the location of the center of gravity of vehicle 12, the speed of vehicle 12 and/or acceleration and deceleration of vehicle 12, the fore-aft slope of vehicle 12, and the side-to-side angle of vehicle 12, and the steering angle, among other measurements and data.

As shown in FIG. 3, CAN 42 can be provided to convert analog sensor measurements to digital form suitable for further processing, where applicable. Sensors 26-36 can measure the various data relating to the real-time vehicle state continuously or at pre-specified time intervals. One or more of sensors 26-36 can be CAN-enabled sensors containing on-sensor electronics for analog to digital conversion ("ADC"). These CAN-enabled sensors can act as a CAN node and transmit sensor data over the CAN 42 or other communication network. One or more of sensors 26-36 can also be analog sensors that continuously monitor the sensed input and transmit an analog signal over dedicated lines to the ECU 40. This monitoring and transmission can also be performed on a selected time interval basis. ECU 40 can include firmware that causes it to act as a CAN node and/or as an ADC for analog inputs. ECU 40 can further transmit CAN messages containing scaled and filtered sensor data over network 42 for use in an application within the user interface 44. The ECU 40 can transmit these CAN messages at time intervals appropriate to the time scale of the events being measured.

As also shown in FIG. 3, a network bridge embedded device 50 can be provided with firmware that allows it to act as a USB device and/or a CAN node. Device 50 can further be configured for translating the CAN messages from ECU 40 into serial messages and transmitting these messages over a USB connection to the user interface device 44. The network bridge device 50 can alternatively or additionally transmit the information via Wi-Fi, Bluetooth, or other wireless configuration. The user interface device 44 can store, read, and display the transmitted sensor data and calculations through software and/or an application. According to one embodiment, the application can perform a plurality of mathematical and/or physics-based calculations and display the output to the user. These calculations are described in greater detail below.

While the foregoing describes in detail one possible configuration of the general system 10 network, it is recognized and understood that any number of suitable configurations, included CAN-based and non-CAN-based configurations now known or hereinafter developed can be incorporated to collect the data from the sensors, process the data, and transmit the data to the processor or user interface device 44. In addition, it is recognized that the processing of the sensor data, including the performance of the necessary calculations to determine the load center and load moment can be performed by ECU 40 or another CAN node so that the data can be logged, stored, aggregated, and/or transmitted to other devices or systems for further or future use.

Figure 5:
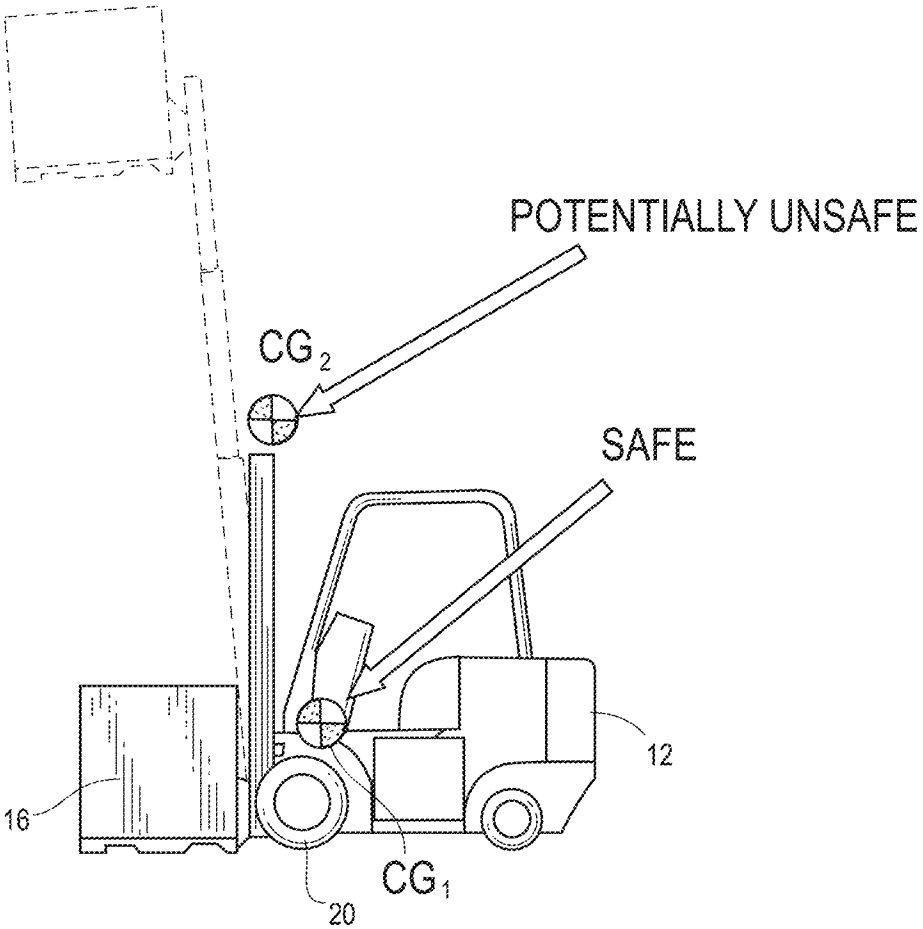
FIG. 5 is a schematic view of a forklift machine illustrating examples of two different positions at which a load may be carried by the forklift machine and also illustrating resulting center of gravity locations for each position.

As previously described, system 10 can be configured to use the sensor data collected by ECU 40 to determine and monitor in real-time the load center of cargo load 16 and the equivalent center of gravity ("CG") and dynamic load moment of the vehicle 12/cargo load 16 combination created by the load center of cargo load 16 and the current dynamic condition of vehicle 12. During a static position, the load center and weight of cargo load 16 can generally be used to define the risk of a tip-over event; however even a below-capacity load can create a tip-over risk when non-static (dynamic) conditions of vehicle 12 are present. As shown in FIG. 5, a safe load moment and center of gravity $CG_1$ for the vehicle 12/cargo load 16 combination is located behind the center of the front wheels 20*a* of forklift 12 and generally at a relatively low height. As further shown in FIG. 5, an unsafe load moment and center of gravity $CG_2$ for the vehicle 12/cargo load 16 combination is located in front of the center of the front wheels 20*a* of forklift 12 and generally at an increased height compared to forklift 12. The positioning of the center of gravity CG in front of the center of front wheels 20*a* creates a risk of a tip-over event.

System 10 can operate by determining (through data obtained by sensors 26-36) the weight and load center of cargo load 16, accounting for the weight and center of gravity of vehicle 12, and then calculating the overall load moment of the vehicle 12/cargo load 16 combination. The application executed on the processor or user interface device 44 can contain software programming for determining this overall load moment using known statics and dynamics mathematical equations and algorithms. For example, the application can use the sensor data to determine the magnitude of cargo load 16, the fore-aft position of cargo load's 16 center of gravity, calculation adjustments that are necessary due to the tilt angle of mast assembly 18, the lift height of mast assembly 18, the ground slope below vehicle 12 and the vehicle 12 accelerations or decelerations, and insert these calculations into a physics model and/or one or more defined algorithms or formulas. This model, algorithm or formula can also incorporate coefficients to account for the specific vehicle 12 and/or attachment 14. The coefficients can be determined through a calibration process 66 as described in greater detail below.

Attention will now be turned to aspects of the present invention whereby system 10 may be adapted for detecting drop-off hazards and other obstacles. System 10 can be configured to identify and alert a vehicle operator to drop-off hazards and other hazards through the use of one or more obstacle or drop-off sensors 46. Obstacle sensors 46 can monitor the surrounding environment and ground location of vehicle 12 to determine if there is an immediate obstruction or significant change in ground floor slope or elevation. A sudden detection event may be determined utilizing or analyzing one or more Boolean conditions (e.g., comparison of thresholds or values, true or false values, etc.) based on, for example, whether or not the floor is present or whether an obstacle is within a pre-defined distance from the vehicle 12.

As shown in FIG. 4, system 10 can be configured with drop-off sensors 46 in the front, back and/or sides of vehicle 12 depending on the specific embodiment of the present invention. According to one embodiment of the present invention, sensors 46 can be configured as 3D sensors; however, it is recognized that other types of suitable sensors can be used, including without limitation, optical sensors, ultrasonic sensors, radio frequency sensors, UT/RF hybrid sensors and magnetic field devices. Upon installation and/or calibration, the sensor(s) 46 should each be directed to a location that provides a suitable buffer zone relative to the vehicle 12 to accommodate for operator reaction time in applying the brakes and vehicle 12 deceleration time and/or distance.

If a drop-off, obstacle or hazard is detected, the vehicle operator can be alerted via device 44, display 52, an obstacle proximity bar 62, visual lights, haptic feedback, seat vibration, and/or an audible signal such as a horn or siren. In one embodiment, a visual alert is presented on the display 52. For example, the display 52 may include a dedicated zone (e.g., near a bottom edge or other suitable location) for alerting the operator of a condition (e.g., a floor drop off near the rear of the vehicle 12 when it is backing up). In another instance, the entire display 52 may be used to present a warning to the operator. For example, the entire display 52 may be turned red with the work "STOP!" located in the middle of the display 52. Other means for alerting the vehicle operator are also within the scope of the present invention.

It will also be appreciated that the vehicle 12 may be adapted such that, when a drop-off, obstacle or hazard event is detected, an automatic intervention may occur wherein the system 10 overtakes control of the vehicle 12 and carries out one or more actions such as reducing the throttle or driving speed, applying the brakes, cutting off power to the wheels, altering the steering and/or other similar processes that override the operator's input.

Figure 6:
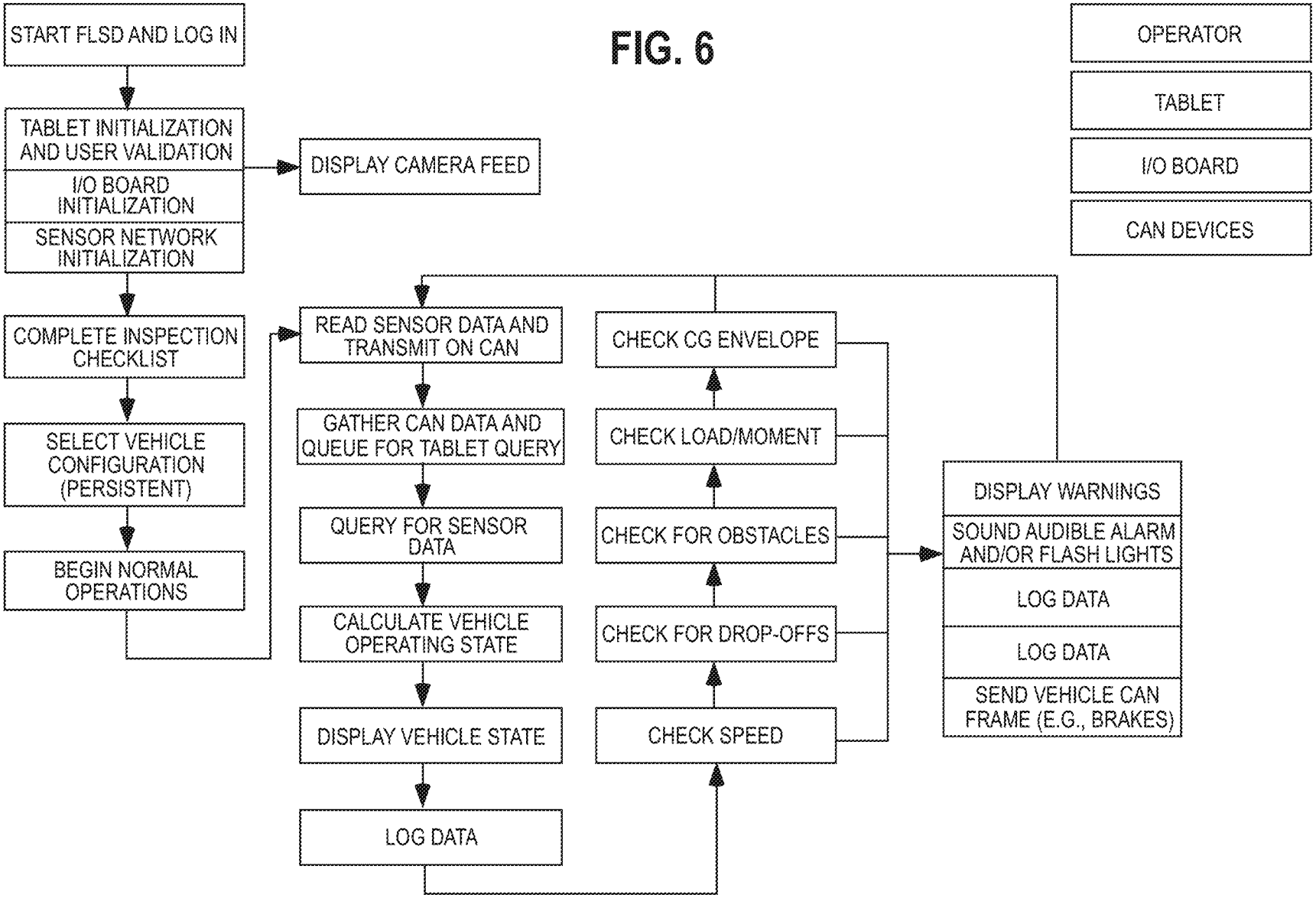
FIG. 6 is a flowchart of the operation processes of an industrial vehicle safety device system in accordance with one embodiment of the present invention.

A flowchart illustrating the methods and processes of system 10, including load moment and dynamic condition calculations and drop-off and hazard detection, according to one embodiment of the present invention is illustrated in FIG. 6.

Figure 7:
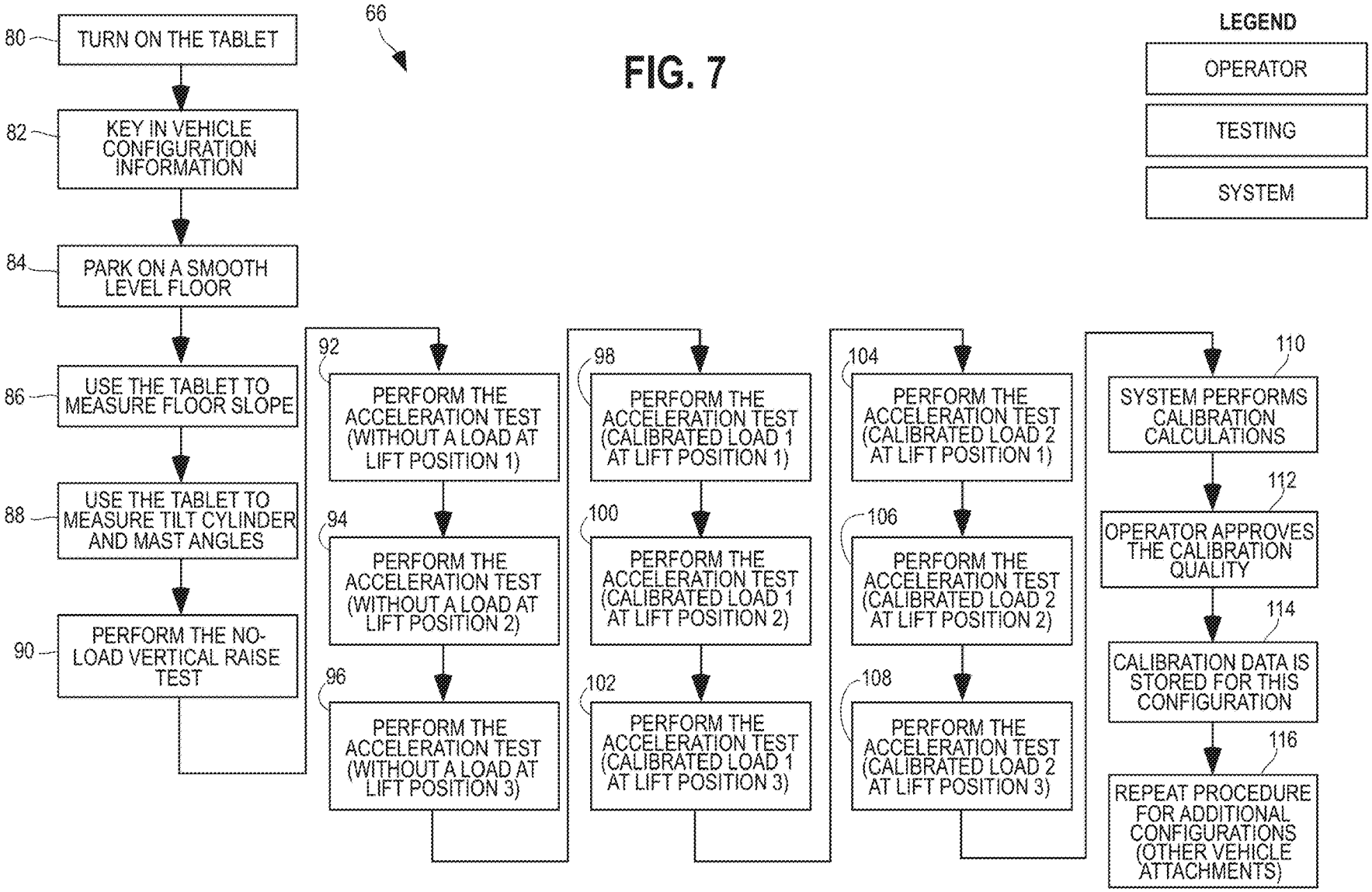
FIG. 7 is a flow chart of a calibration process for use with an industrial vehicle safety device system in accordance with one embodiment of the present invention.

Attention will now be turned to aspects of the present invention whereby system 10 may calibrated for use. Referring to FIG. 7, system 10 can include a calibration system and procedure 66 for determining the proper coefficients for system's 10 physics and mathematical models, algorithms and formulas as applied to the specific vehicle 12 and/or attachment 14. As a result, system 10 can be calibrated for each specific vehicle 12 and each attachment 14 for the specific vehicle 12. It will be understood that the system 10 may be recalibrated any time a different attachment 14 is added to the vehicle 12 and/or any time there are changes made to the vehicle 12 that may impact its operating characteristics. It will further be appreciated that an existing vehicle 12 can be retrofitted with a system 10 and that the system 10 would be calibrated upon installation on the vehicle 12.

In one embodiment, calibration system and process 66 can use a series of static and dynamic tests and regression data from these tests to determine the proper coefficients for a base vehicle 12 configuration and each vehicle 12/attachment 14 combination intended for use with system 10. As shown in the flowchart of FIG. 7, during the calibration procedure 66, sensors 26-36 can collect data for the vehicle 12/attachment combination without a load and with a load and ECU 40 can interpret the collected sensor data and transmit it to device 44. The application on device 44 can contain programming to (i) store the raw sensor data until a sufficient amount has been collected, (ii) solve systems of equations for the coefficients of the applicable physics model, and (iii) store the coefficients under a user-selectable vehicle 12 configuration heading. As a result, each time a specific vehicle 12/attachment 14 combination is used with system 10, the application can identify the correct coefficients.

One embodiment of the calibration routine uses published general vehicle 12 data, specifications and dimensions to infer vehicle parameters, such as the vehicle's 12 no-load CG location (i.e., the CG of the vehicle 12 when it is not carrying a cargo load 16). Some or all of this information may be pre-loaded and stored in the system 10. Additionally or alternatively, a user or operator may input various vehicle 12 data, specifications and dimensions. In that manner, the calibration routine may be adapted for calibrating or configuring the system 10 for vehicles for which accurate engineering data is not known, such as a field installation on an older vehicle. This information can include distances, weights and other parameters that can be measured or otherwise obtained by the user. Non-limiting examples of such information may include the overall weight of vehicle 12, the distance between front and rear wheels 20*a* and 20*b*, the amount of weight on front wheels 20*a*, the amount of weight on rear wheels 20*b*, the surface area of lift cylinder's 22 piston, the maximum possible stroke of the lift cylinder 22, the maximum possible vertical displacement of attachment 14, the surface area of tilt cylinder's 24 piston less the cross-sectional area of tilt cylinder's 24 rod, the maximum possible stroke of the tilt cylinder 24, the maximum possible angular displacement of mast 18, the distance between the tilt cylinder 24 and the mast pivot, the maximum speed of vehicle 12, and other various data, specifications and dimensions of the vehicle 12 that may be obtained by a user. It will be appreciated that calibration routine of the present invention may utilize the methodology described above in determining the location of the CG for the vehicle 12 and the location of the CG for the vehicle 12/cargo load 16 combination.

System 10 can employ known non-load conditions and load conditions of vehicle 12 to determine the proper coefficients of vehicle 12. FIG. 7 illustrates one embodiment of the calibration process 66. It will be appreciated that the steps 80-116 shown in FIG. 7 may be undertaken in various orders and sequences. It will be further understood that, in some instances, not all of the steps provided in FIG. 7 need be employed and that additional steps, as discussed herein, may also be undertaken.

At block 80, the user powers up the interface device 44 along with other applicable components of the system 10. As discussed above, the user may then optionally enter in one or more pieces of vehicle configuration information at block 82. At block 84, the vehicle 12 is placed on a generally level floor surface and, at block 86, the slope of the floor may be measured and recorded using components of the system 10 (e.g., a gyroscope or tilt sensor) or other measuring devices. The displacement of the tilt cylinder 24 and/or angle of the mast 18 may be measured and recorded at block 88. At block 90, one or more vertical raise tests may be undertaken. In one embodiment, these tests are performed while the vehicle 12 is static, although additionally or alternatively, the vertical raise tests may be performed while the vehicle 12 is moving. It will be appreciated that the raise tests can be undertaken with no load located on the attachment 14, although additionally or alternatively, the vertical raise tests may be performed with one or more loads of known masses located on the attachment 14.

One or more dynamic tests or routines, such as acceleration tests and/or deceleration tests, may be performed at blocks 92-108. The data, results and information from each of these tests may be recorded and stored by the system 10. At block 92, an acceleration and/or deceleration test can be performed with the attachment 14 located at a first position (e.g., a lowered positon just above the floor) and with no load placed on the attachment 14. At block 94, an acceleration and/or deceleration test can be performed with the attachment 14 located at a second position (e.g., an intermediately raised position, such as a position about half way between a fully lowered and fully raised position) and with no load placed on the attachment 14. At block 96, an acceleration and/or deceleration test can be performed with the attachment 14 located at a third position (e.g., a higher raised position, such as a fully raised position) and with no load placed on the attachment 14.

The dynamic testing may then continue with a first load of a known mass placed on the attachment 14. At block 98, an acceleration and/or deceleration test can be performed with the attachment 14 located at a first position and with the first known load placed on the attachment 14. At block 100, an acceleration and/or deceleration test can be performed with the attachment 14 located at a second position and with the first known load placed on the attachment 14. At block 102, an acceleration and/or deceleration test can be performed with the attachment 14 located at a third position and with the first known load placed on the attachment 14.

The dynamic testing can then continue with a second load of a known mass placed on the attachment 14. It will be appreciated that the second known load may have a mass that is either greater than or less than the mass of the first known load. At block 104, an acceleration and/or deceleration test can be performed with the attachment 14 located at a first position and with the second known load placed on the attachment 14. At block 106, an acceleration and/or deceleration test can be performed with the attachment 14 located at a second position and with the second known load placed on the attachment 14. At block 108, an acceleration and/or deceleration test can be performed with the attachment 14 located at a third position and with the second known load placed on the attachment 14.

It will be appreciated that the no-load testing described above can be undertaken to establish baseline parameters throughout the range of motion of vehicle's 12 lifting apparatus. These no-load tests can be suitable for characterizing the frictions within the vehicle 12, and may also be used to calibrate and set baselines or zero points for the sensors.

Similarly, the loaded testing described above can be undertaken to calculate sensor data and load moments throughout a range of motion of the vehicle's lifting apparatus. The load tests can be suitable for establishing correction factors for load-dependent effects, such as increased friction, stretching of chains, hoses, and other spring-style effects, among others.

System 10 can be included with a guided calibration routine by which the user or operator is instructed to undertake certain actions via the user interface device 44 or otherwise. These actions may include, but are not limited to, those steps illustrated by blocks 80-116 in FIG. 7. For example, the user or operator may be instructed to raise the attachment 14 to specified heights, both with and without a load placed thereon. The user or operator may also be instructed to place certain weighted loads on the attachment 14, as well as to accelerate the vehicle 12 with a load at one or more various specified heights, and also to apply the brakes to decelerate the vehicle 12 at a specified speed or time.

Attention will now be turned to aspects of the present invention whereby the dynamic load moment and other information relating to the operation of vehicle 12 are displayed to the operator. System 10 can be configured to display the status of the dynamic load moment of the vehicle 12/cargo load 16 combination in real time on the user interface device 44. This device 44 can allow the vehicle operator view the safety condition of vehicle 12 and identify the weight, load, load moment, and speed capacity of vehicle 12 while taking into account its dynamic conditions. As set forth above, system 10 and display 52 can be configured to display the dynamic conditions of vehicle 12 on a real-time basis or, alternatively, some or all of the conditions may be updated and displayed on a semi-continuous or time-interval basis.

Figure 8:
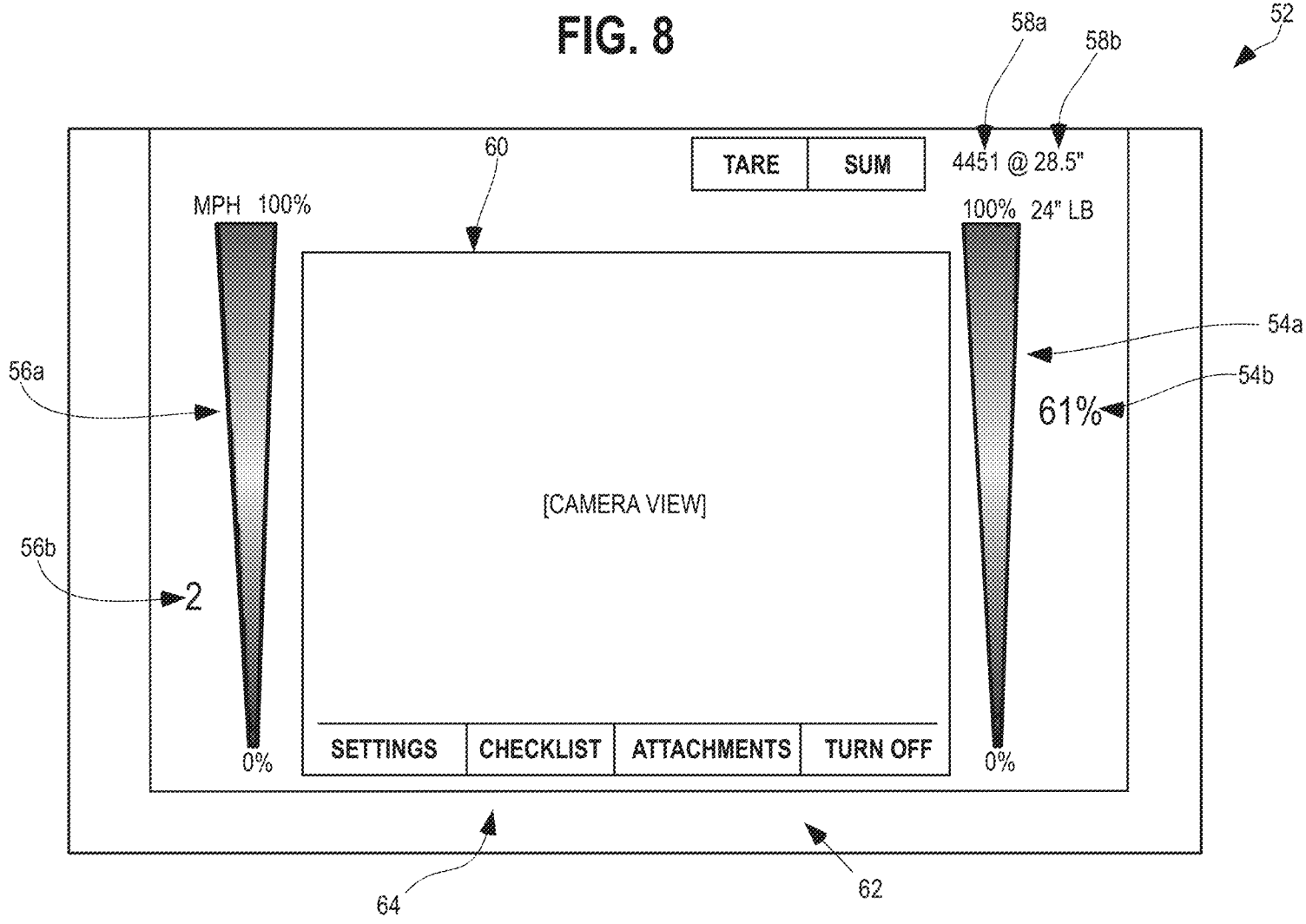
FIG. 8 is a schematic view of a display on a user interface device for use with an industrial vehicle safety device system in accordance with one embodiment of the present invention.

FIG. 8 illustrates the display 52 of device 44 according to one embodiment of the present invention. As shown, display 52 can include a scale 54*a* and a numeric percentage 54*b* representing a percentage of used load moment capacity of the vehicle 12. Alternatively, numeric value 54*b* may be expressed as the actual dynamic load moment instead of as a percentage. Display 52 may also include a scale 56*a* representing the current speed relative to a threshold maximum speed based on the current conditions and a numeric value 56*b* representing the current speed of the vehicle 12. It will be appreciated that the scales 54*a* and 56*a* may be of any suitable visual configuration including, but not limited to, a vertically- or horizontally-oriented thermometer-style scale, a linear gradient scale, a circular or semi-circular scale, or any other suitable geometric or graphical configuration.

The scale 54*a* representing the percentage of the load moment capacity being used can be a color-coded continuous or sliding scale that includes a continuum of colors, from blue to green to yellow to orange to red, that transition in color from bottom to top (or left to right in the case of a horizontal scale, for example). The numeric percentage 54*b* alongside the scale 54*a*, which again displays the load moment in terms of percentage of maximum capacity used, may similarly be a continuous or sliding scale that transitions in color (from blue to green to yellow to orange to red) corresponding to its position relative to scale 54*a*. This can enable the operator to gain instant and real-time information regarding the fore-aft stability of vehicle 12. The capacity indication number 54*b* can also move up and down the scale 54*a* not only when loads are lifted, but also when other conditions occur that would affect the load moment, such as when vehicle 12 is driven up or down a slope, when the mast assembly 18 is tilted forward or backward, and when vehicle 12 is accelerated or decelerated when speeding up or slowing down.

Like scale 54*a*, scale 56*a* may also be similarly color-coded and, like the numeric percentage 54*b*, number 56*b* can also be color-coded and can move up and down relative to scale 56*a*. The color-coded speed scale 56*a* can be adapted to not only display the speed of vehicle 12, but it can also optionally display an indication of the used portion of the context sensitive speed limit that is corrected for: (i) the lifted load and load moment; (ii) the lift height; (iii) the ground slope; and (iv) any user-inputted limits. Like the scale 56*a*, its associated speed number 56*b* may transition in color as it moves up and down relative to the scale 56*a*.

In other embodiments, it will be appreciated that display 52 may be a monochromatic, black and white or other type of display that does not include color. In such instances, it will be appreciated that the scales 54*a* and 56*a* need not be in color and can alternatively include a monochromatic continuous gradient from bottom to top. For example, such the gradient may become increasing darker from bottom to top. The same may also apply to numbers 54*b* and 56*b*.

The scales 54*a* and 56*b*, numbers 54*b* and 56*b* and/or other portions of the display 52 may begin to flash as the load moment or speed reaches a maximum threshold (e.g., near 100%) to draw the operator's attention.

As shown in FIG. 8, display 52 can further include information relating to the cargo load's 16 weight 58*a* and the location 58*b* of the CG of the cargo load 16. In other embodiments, the displayed weight 58*a* may be that of the overall weight of the vehicle 12/cargo load 16 combination and the displayed location 58*b* may be that of the overall CG of the vehicle 12/cargo load 16 combination. The location 58*b* of the CG may be presented in terms of its fore-aft distance from (either in front or behind) the center of the front wheels 20*a*. By way of example and with reference to FIG. 8, the display 52 conveys to the operator that 61% of the vehicle's 12 load moment capacity is used, the current speed of the vehicle is 2 miles per hour, the load is 4451 pounds, and the CG is located 28.5 inches from the center of the center of the front wheels 20*a*.

Additionally, display 52 may include a portion for showing a camera view 60 (e.g., a view from behind the vehicle 12), a color-coded obstacle proximity bar 62 that may change color to indicate to the operator how close the vehicle 12 is relative to an obstacle, and various control or menu fields 64 of buttons. Camera view 60 can provide an optional video feed on device 44 from camera 48. Camera 48 can be equipped with attachment means to allow the vehicle operator to attach camera 48 anywhere on vehicle 12 (or cargo load 16) to provide for additional visibility in the direction (e.g., front, rear or a side) of the operator's choosing.

Figure 9:
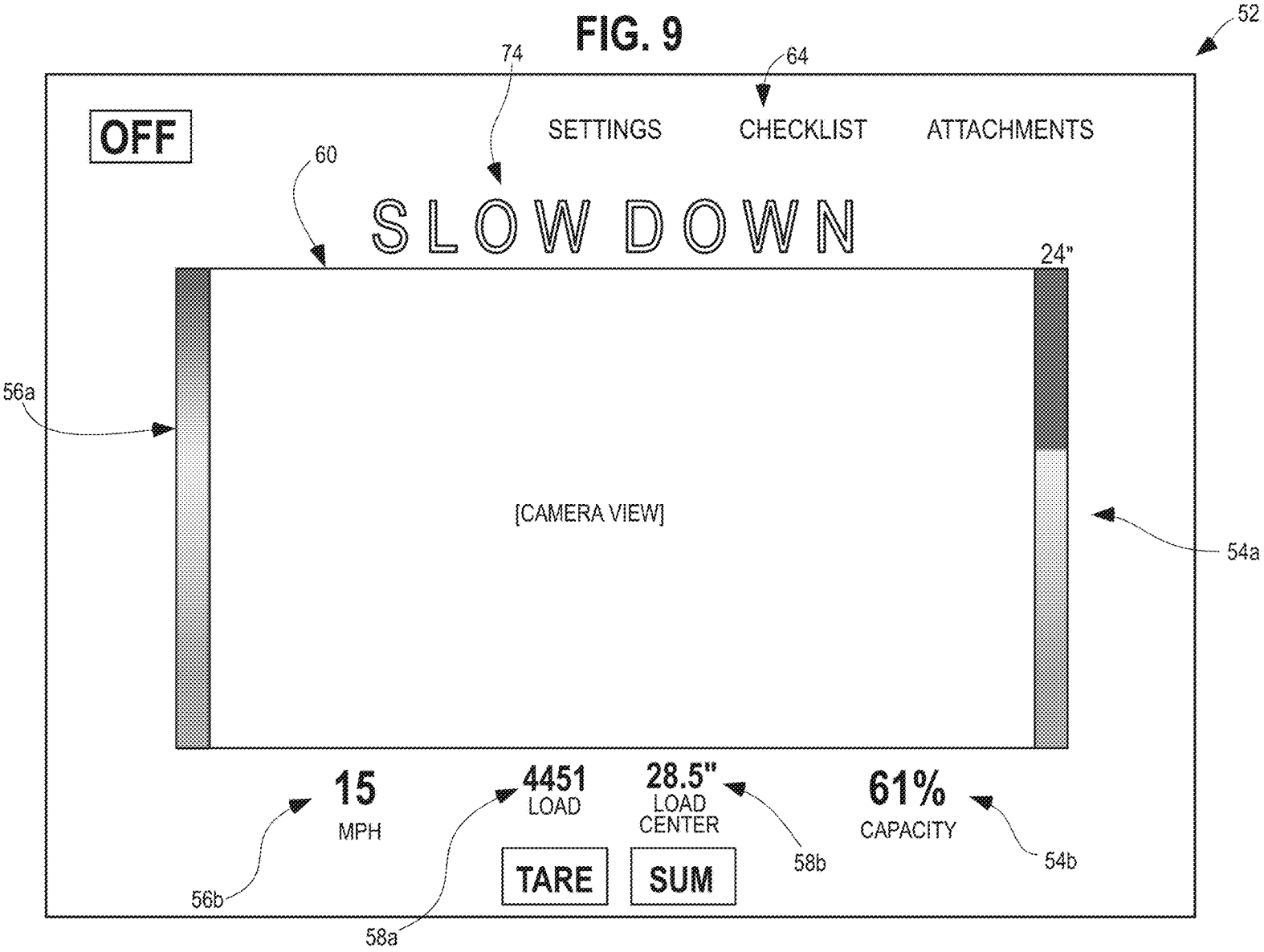
FIG. 9 is a schematic view of a display on a user interface device for use with an industrial vehicle safety device system in accordance with another embodiment of the present invention.

FIG. 9 illustrates a display 52 according to another embodiment of the present invention. Aspects of the display 52 shown in FIG. 9 can be similar to those described above relative to the display 52 shown in FIG. 8. Accordingly, display 52 illustrated in FIG. 9 can include a color-coded continuous sliding scale bar 54*a* representative of the percentage of the load moment capacity of vehicle 12 and a color-coded sliding scale bar 56*a* representative of the speed of vehicle 12 similar to the embodiment shown in FIG. 8. Scales 54*a* and 56*a* can be adapted to progressively fill from bottom to top as the load moment or speed increases.

In this embodiment, scale 54*a* can additionally include a percentage display 54*b* of the used load moment capacity. Similarly, scale 56*a* can include a numerical display 56*b* of the speed of vehicle 12. Display 52 according to this embodiment can also include numerical display of load data 58*a* and load center data 58*b*, a camera view 60 and various menu fields 65 similar to the embodiment illustrated in FIG. 8. As specifically shown in FIG. 9, display 52 can additionally include a warning indicator zone 74 that can provide various warnings to the operator, such as speed warnings, tip-warnings, obstacle and drop-off hazards, and other safety concerns. This display zone 74 can also color coordinated based on the severity of the hazard or condition.

As discussed above, system 10 can be configured to display and alert through display 52, augment operator commands and decision making, and even override the vehicle operator when certain warning conditions are present. For example, the application executed on the processor or user interface device 44 can include database of set points and thresholds, which can be specific to vehicle 12 and/or attachment 14, that can be used to alert the vehicle operator of unsafe tip-over conditions. If a set point or threshold is exceeded, the device 44 can notify the operator via display 52 or otherwise. This warning system can also be configured to be based on the severity level of the possible tip-over event and/or the type of tip-over (i.e., forward or lateral).

Attention will now be turned to aspects of the present invention whereby system 10 may be adapted to override manual controls of vehicle 12 in certain instances. An automatic intervention may occur wherein the system 10 overtakes control of the vehicle 12 and carries out one or more actions, such as reducing the throttle or driving speed, applying the brakes, cutting off power to the wheels, altering the steering and/or other similar processes that override the operator's input.

For example, according to one embodiment of the present invention, an override feature is provided for reducing the throttle and/or applying the brakes when (a) a risk of tip-over is high or exceeds a certain threshold, (b) a set speed point or threshold is reached (e.g., using a selectable percentage of context sensitive speed allowance), (c) a drop-off or other obstacle or hazard is detected and the operator ignores the warning, or (d) an imminent collision is detected and the operator ignores the warning. It will be appreciated that the steering of the vehicle 12 may also be overridden in one or more of instances, for example to avoid a drop-off, obstacle, hazard or collision. In another aspect of the invention, the vehicle 12 may be automatically shut down or prevented from starting when (a) the operator's license is no longer current, (b) an inspection checklist has not been completed, (c) the operator is not in the seat, or (d) the seat belt is not worn and the operator ignores the warning. The upward lift of the attachment 14 can be automatically prevented and/or the height of the attachment 14 may be automatically reduced in certain instances, such as when the current load moment would create a tipping hazard if the attachment 14 and cargo load 16 were lifted upward and/or allowed to remain at its current height. Similarly, the forward tilt of the mast assembly 18 can be automatically prevented and/or the tilt of the mast assembly 18 may be automatically reduced in certain instances, such as when the current load moment or lift height would create a tipping hazard if the mast assembly 18 were tilted forward and/or allowed to remain at its current tilt angle.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method for calibrating a system for dynamically monitoring the stability of an industrial vehicle with a lifting device having a tilt cylinder, the method comprising the steps of:

performing a no-load acceleration routine including:

accelerating the vehicle with the lifting device at a first position and without a cargo load thereon;

determining simultaneously both an acceleration of the vehicle and a force on the tilt cylinder at one or more instances during the no-load acceleration routine;

performing a first-load acceleration routine including:

accelerating the vehicle with the lifting device at the first position and having a first cargo load with a first known mass thereon;

simultaneously determining both the acceleration of the vehicle and the force on the tilt cylinder at one or more instances during the first-load acceleration routine;

calculating at least one coefficient associated with the vehicle, wherein the at least one coefficient is calculated based on the acceleration of the vehicle and the force on the tilt cylinder during the no-load acceleration routine and the acceleration of the vehicle and the force on the tilt cylinder during the first-load acceleration routine.

2. The method of claim 1 further comprising the steps of:

accelerating the vehicle with the lifting device at a second position and without a cargo load thereon during the no-load acceleration routine; and accelerating the vehicle with the lifting device at the second position and having the first cargo load thereon during the first-load acceleration routine.

3. The method of claim 2 further comprising the steps of:

accelerating the vehicle with the lifting device at a third position and without a cargo load thereon during the no-load acceleration routine; and accelerating the vehicle with the lifting device at the third position and having the first cargo load thereon during the first-load acceleration routine.

4. The method of claim 3 further comprising the steps of:

performing a second-load acceleration routine including:

accelerating the vehicle with the lifting device at the first position and having a second cargo load with a second known mass thereon;

accelerating the vehicle with the lifting device at the second position and having the second cargo load thereon;

accelerating the vehicle with the lifting device at the third position and having the second cargo load thereon; and simultaneously determining both the acceleration of the vehicle and the force on the tilt cylinder at one or more instances during the second-load acceleration routine.

5. The method of claim 1 further comprising the steps of:

inputting configuration information of the vehicle into the system;

measuring a slope of a ground floor beneath the vehicle and inputting the slope into the system;

measuring an angle of a mast of the lifting device and inputting the mast angle into the system; and measuring an angle of the tilt cylinder of the lifting device and inputting the tilt cylinder angle into the system.

6. The method of claim 1, wherein the force on the tilt cylinder is determined by measuring a pressure within the tilt cylinder.

7. The method of claim 1 further comprising the steps of:

determining a location of a center of gravity of the vehicle during the no-load acceleration routine;

determining a load moment of the vehicle during the no-load acceleration routine;

determining a location of a center of gravity of the vehicle and the first cargo load combination during the first-load acceleration routine; and determining a load moment of the vehicle and the first cargo load combination during the first-load acceleration routine.

8. The method of claim 1, wherein the at least one coefficient is calculated based further on a mass of the vehicle and a position of the lifting device during the acceleration routines.

9. The method of claim 8, wherein the at least one coefficient is determined using linear regression of data collected during the no-load acceleration routine and the first-load acceleration routine.

* * * * *